US008366029B2

(12) United States Patent
Becker et al.

(10) Patent No.: US 8,366,029 B2
(45) Date of Patent: Feb. 5, 2013

(54) METHOD FOR DETERMINING A REFUSE FILLING LEVEL

(75) Inventors: Norbert Becker, Röttenbach (DE); Hans-Ulrich Löffler, Erlangen (DE); Stefan Smits, Hemhofen (DE); Kurt Tischler, Erlangen (DE)

(73) Assignee: Siemens Aktiengesellschaft, Munich (DE)

( * ) Notice: Subject to any disclaimer, the term of this patent is extended or adjusted under 35 U.S.C. 154(b) by 521 days.

(21) Appl. No.: 12/376,596

(22) PCT Filed: Jun. 19, 2007

(86) PCT No.: PCT/EP2007/056072

§ 371 (c)(1),
(2), (4) Date: Jun. 1, 2010

(87) PCT Pub. No.: WO2008/019904

PCT Pub. Date: Feb. 21, 2008

(65) Prior Publication Data

US 2010/0237175 A1 Sep. 23, 2010

(30) Foreign Application Priority Data

Aug. 14, 2006 (DE) ..... 10 2006 038 014

(51) Int. Cl.
*B02C 25/00* (2006.01)

(52) U.S. Cl. ..... 241/30; 241/35

(58) Field of Classification Search ..... 241/30, 241/34, 35, 36, 170

See application file for complete search history.

(56) References Cited

U.S. PATENT DOCUMENTS

| | | | | |
|---|---|---|---|---|
| 4,722,485 | A | 2/1988 | Young et al. | |
| 6,619,574 | B1 * | 9/2003 | Fontanille et al. | 241/30 |
| 2010/0237175 | A1 | 9/2010 | Becker et al. | |

FOREIGN PATENT DOCUMENTS

| | | | |
|---|---|---|---|
| DE | 4215455 | | 11/1993 |
| DE | 4215455 | A1 | 11/1993 |
| DE | 19747628 | | 5/1999 |
| DE | 19747628 | A1 | 5/1999 |
| DE | 60005811 | T2 | 8/2004 |
| SU | 1607952 | A1 | 11/1990 |
| SU | 1620141 | A1 | 1/1991 |
| WO | 2004065014 | | 8/2004 |
| WO | WO 2004065014 | A1 | 8/2004 |
| WO | 2008/019904 | A1 | 2/2008 |

OTHER PUBLICATIONS

International Search Report and Written Opinion for Application No. PCT/EP2007/056072 (8 pages), Sep. 26, 2007.
Russian Office Action, Russian patent application No. 2009109192, 6 pages, May 18, 2011.

* cited by examiner

*Primary Examiner* — Faye Francis
(74) *Attorney, Agent, or Firm* — King & Spalding L.L.P.

(57) ABSTRACT

The method is used to determine the filling level of a loaded mill container (2). The container (2) has a drive torque (M) applied to it by means of a drive (6), and causes it to rotate. The drive torque (M) on the drive (6) is set by means of a predeterminable drive test sequence. A time/rotation speed profile of a rotation speed of the container (2) which results from the drive test sequence is recorded, and is analyzed. The filling level is determined on the basis of the results of the analysis. The method produces up to date, accurate information, determined during the milling operation, about the filling level of the container (2).

19 Claims, 3 Drawing Sheets

METHOD FOR DETERMINING A REFUSE FILLING LEVEL

CROSS-REFERENCE TO RELATED APPLICATIONS

This application is a U.S. National Stage Application of International Application No. PCT/EP2007/056072 filed Jun. 19, 2007, which designates the United States of America, and claims priority to German Application No. 10 2006 038 014.2 filed Aug. 14, 2006, the contents of which are hereby incorporated by reference in their entirety.

TECHNICAL FIELD

The invention relates to a method for determining a filling level of a loaded drum of a mill.

BACKGROUND

Such a mill can be, for example, a ball mill, or else an SAG (semi autogeneously grinding) mill that is intended for milling coarse grained materials such as, for example, ores or cement etc. In the case of such mills, the current filling level in the drum in which the comminution takes place is normally unknown. Specifically, the filling level depends on many variables. Examples of these are the exact degree of milling, the proportion of balls that are introduced into the drum to assist the milling operation, the degree of wear of these balls, and the proportion of solids in the suspension that is currently located in the drum. These variables change for the most part during operation of the mill. Their current values are unknown in the same way as is the value of the filling level itself.

A somewhat accurate knowledge of the current filling level would also be very advantageous since it would be possible to derive conclusions therefrom regarding the efficiency of the mill operation. In the case of overfilled mills, the comminution is inefficient owing to the small dropping height and the energy absorption of the already comminuted milling stock. In the case of underfilled mills, the drum walls and the drivers can be damaged. The speed of the drum can be better set with the aid of the current filling level and, if appropriate, further parameters such as the hardness of the stock or the proportion of solids to be milled.

At present, the filling level is estimated by the operating staff using its empirical values. Weight sensors that determine the applied weight of the loaded drum on the bearings are used by way of support. Despite these additionally provided sensors, this estimation method is very inaccurate. Acoustic measuring methods have also recently been developed, but these likewise require additional sensors for receiving sound.

Conventional methods for acquiring filling levels such as, for example, the rotating vane, pendulum and vibration measuring methods offered by Mollet Füllstandstechnik GmbH by means of the website http://www.mollet-gmbh.de/ are suitable, rather, for stationary storage containers but not for a rotating and loaded drum of a mill.

SUMMARY

According to various embodiments, a method and a device can be specified that enable the filling level of the drum to be determined currently in a simple way during operation of the mill.

According to an embodiment, a method for determining a filling level of a loaded drum of a mill, may comprise the steps of: a) applying to the drum a drive torque by a drive that sets the drum into a rotational movement, b) setting the drive torque at the drive in accordance with a prescribable drive test sequence, c) acquiring a temporal speed characteristic of a speed of the drum caused by the drive test sequence, d) analyzing the acquired speed characteristic, wherein an inertia torque of the loaded and driven drum is determined during analysis of the speed characteristic, and e) determining the filling level with the aid of results of the analysis.

According to a further embodiment, a speed frequency signal that is tested in particular with regard to the frequency components involved can be generated from the acquired temporal speed characteristic by means of a Fourier transformation during the analysis of the speed characteristic. According to a further embodiment, the filling level can be inferred from the presence, from the amplitude or from the phase of specific frequency components. According to a further embodiment, as drive test sequence a constant drive torque can be prescribed, or use can be made of a drive torque that is prescribed for the normal operation of the mill, in particular by a drive controller. According to a further embodiment, the acquired speed characteristic can be subjected to a filtering or an averaging during the analysis of the speed characteristic. According to a further embodiment, a drive torque having at least one step change, in particular with a change in the form of a square-wave pulse, can be prescribed as drive test sequence. According to a further embodiment, the change in the drive torque referred to an initial value of the drive torque may move in a range of up to 30%, in particular of up to 10%, and in particular of up to 2%. According to a further embodiment, the square-wave pulse may have a pulse duration and a pulse height determining the change in the drive torque, and a first measured value is determined for the inertia torque with the aid of the pulse duration, the pulse height and a speed change caused by the drive test sequence and acquired. According to a further embodiment, to determine the filling level, the first measured value determined for the inertia torque of the loaded and driven drum may be compared with the inertia torque of a circular arc segment in order to determine therefrom, in particular, a filling angle or a filling height. According to a further embodiment, a time dependence or speed dependence of the inertia torque can be taken into account by at least one additionally correction factor. According to a further embodiment, a speed regulator provided for the normal operation of the mill may be switched off at least during one period of the drive test sequence. According to a further embodiment, an inertia torque of the loaded and driven drum and a static friction factor of a speed-dependent friction torque can be determined from the speed characteristic and the drive test sequence. According to a further embodiment, the inertia torque and the static friction factor can be determined on the basis of a linear model, the linear model describing the dependence of the speed on the drive torque. According to a further embodiment, the linear model can be a PT1 element and, in order to determine the inertia torque and the static friction factor, the PT1 element is tuned at two instants with measured values of the speed and of the drive torque.

According to another embodiment, a control device for a mill, may comprise a program code that has control commands that prompt the control device to carry out such a method.

According to yet another embodiment, a machine-legible program code for a control device for a mill, may have control commands that prompt the control device to carry out such a method.

According to another embodiment, a storage medium may comprise such a machine-legible program code.

BRIEF DESCRIPTION OF THE DRAWINGS

Further features, advantages and details of the invention emerge from the following description of exemplary embodiments with the aid of the drawing, in which.

Mutually corresponding parts are provided with the same reference symbols in FIGS. 1 to 7.

DETAILED DESCRIPTION

Figure 1:
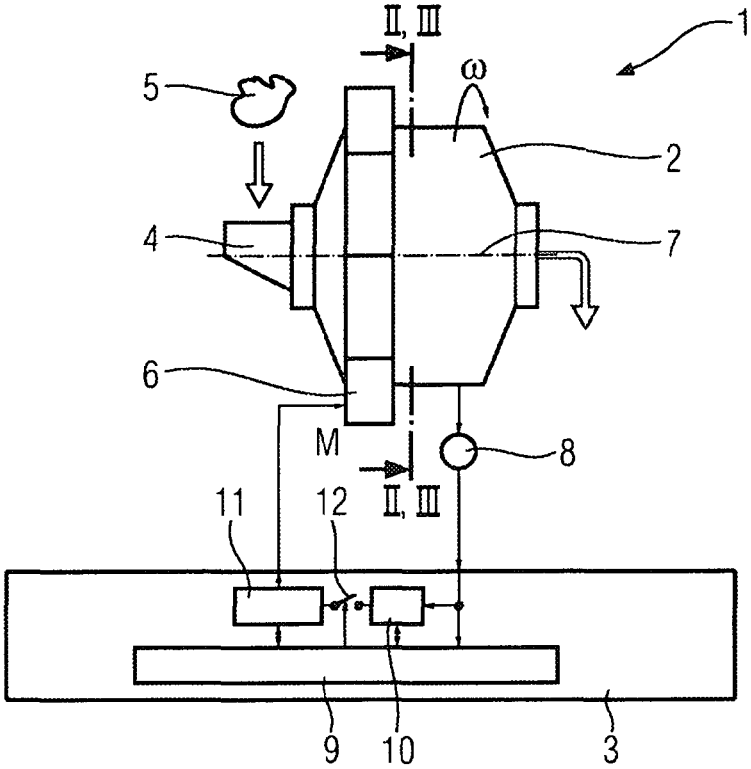
FIG. 1 shows an exemplary embodiment of a mill with a loaded drum that can be driven to rotate about a rotation axis, and with a control and regulation unit.

According to an embodiment, in a method for determining a filling level of a loaded drum of a mill, a) a drive applies to the drum a drive torque that sets it into a rotational movement,
b) the drive torque is set at the drive in accordance with a prescribable drive test sequence,
c) a temporal speed characteristic of a speed of the drum caused by the drive test sequence is acquired,
d) the acquired speed characteristic is analyzed, and
e) the filling level is determined with the aid of results of the analysis.

The method according to various embodiments is distinguished from the long-known, customary and very inaccurate estimation methods firstly in having a higher accuracy, and secondly in that it can also be carried out in an automated fashion and, above all, as the mill is being operated. Thus, in particular, it is also possible to determine a current measured value for the filling level. The method according to various embodiments is advantageously based first and foremost on the acquisition of the speed, something which is provided in any case for controlling the normal mill operation. This measured variable is therefore already available in a suitable, for example electronic form in an evaluation unit. Thus, in particular, there is no need for additional sensors such as, in the case of the prior art, for example, the weight sensors for the applied weight of the drum. Again, the drive test sequence can be set in a simple way at the drive, the result being overall only a comparatively low outlay on implementing the method according to various embodiments.

It may be advantageous when a speed frequency signal that is tested in particular with regard to the frequency components involved is generated from the acquired temporal speed characteristic, and in particular after digitization, by means of a Fourier transformation during the analysis of the speed characteristic. Periodic perturbations in the speed result from the milling stock striking the drivers, and these can be effectively acquired and evaluated by means of a Fourier analysis. Preferably, the filling level can be inferred from the presence, from the amplitude or from the phase of specific frequency components. The acquired speed signal can thus be tested particularly well and comprehensively. The outlay for this is easy to grasp. A Fourier transformation can be carried out straight away electronically and in an automated fashion.

In accordance with another preferred variant, as drive test sequence a constant drive torque is prescribed, or use is made of a drive torque that is prescribed for the normal operation of the mill, in particular by a drive controller. The drive controller is thus, in particular, present in any case. It can usually prescribe both a drive torque and a speed. When use is made of said drive test sequence, the method of determining the filling level is particularly simple. Thus, it manages practically without intervention in the prescription or setting of the drive torque. The normal mill operation is then not even slightly impaired by a change in the drive torque but is caused by the acquisition of the filling level. Nevertheless, the information of interest with reference to the filling level can be determined by analyzing the Fourier transforms of the speed characteristic.

Furthermore, the acquired speed characteristic is preferably subjected to a filtering, in particular a low-pass filtering, and/or an averaging (median) during the analysis of the speed characteristic. Fluctuations can thus be removed, and an already very good first approximation value for the filling level being sought can be determined more easily.

Moreover, it may be advantageous when an inertia torque of the loaded and driven drum is determined during analysis of the speed characteristic. The inertia torque is a particularly well suited intermediate variable that can be used to determine the current filling level easily and yet with high accuracy.

Also advantageous may be a variant in the case of which a drive torque having at least one step change, in particular with a change in the form of a square-wave pulse, is prescribed as drive test sequence. In particular, the drive test sequence has two consecutive changes in the form of square-wave pulses and having opposite directions of change. Such a step function in the drive torque leads to a reaction in the speed characteristic that can be acquired and evaluated easily. The associated step responses, in particular, are thus then evaluated.

It may be also advantageous when the absolute change in the drive torque referred to an initial value of the drive torque moves in a range of up to 30%, in particular of up to 10%, and in particular of up to 2%. It is then the case that the change in the drive torque is, on the one hand, large enough to cause reaction that can be evaluated and, on the other hand, not yet too large to impair the normal milling operation appreciably. In the case of the variant with two consecutive changes in the form of square-wave pulses and having opposite directions of change, the two square-wave pulses can be formed identically apart from the sign, that is to say symmetrically. However, square-wave pulses that are not identical or follow one another asymmetrically are also possible. For example, the two square-wave pulses can have different pulse durations and pulse heights, but identical time integrals. It is thereby possible, for example, to avoid overshooting of a prescribed maximum mill speed. The first pulse is therefore preferably selected with a negative direction of change, and the second pulse with a positive direction of change as well as with an absolute pulse height identical to that of the first pulse. The first negative drive torque pulse then slows down the speed, while the second positive drive torque pulse reaccelerates the mill up to the original speed. It may be advantageous to evaluate only a negative drive torque pulse, since influence of the mill torque is less in the case of negative drive torque pulses.

There may be an advantage in a further variant, in the case of which the square-wave pulse has a, in particular prescribable and thus known, pulse duration and an, in particular likewise prescribable and known, pulse height determining the change in the drive torque, and a first measured value is determined for the inertia torque with the aid of the pulse duration, the pulse height and a speed change caused by the drive test sequence and acquired. In particular, an average change in speed and, derived therefrom, a mean value of the inertia torque are determined, it being preferred to assume a static, that is to say temporally invariable, inertia torque.

In a very good approximation, the inertia torque is then, in particular, proportional to the quotient of the product of the pulse duration and the pulse height (=numerator) to the acquired (mean) change in speed (=denominator). The result is thus a relationship between said variables that is very simple and can also be evaluated easily and numerically.

In accordance with another preferred variant, to determine the filling level, the first measured value determined for the inertia torque of the loaded and driven drum is compared with the inertia torque of a circular arc segment in order to determine therefrom, in particular, a filling angle or a filling height. It has been found that given the speeds customarily used during operation, the loading inside the drum is distributed such that the filling stock is always arranged to a good approximation inside a circular arc segment. Consequently, the filling level in the drum can be determined with the aid of the known inertia torque of a circular arc segment, and with the aid of the measured value determined for the inertia torque.

It may be further advantageous when a time dependence or speed dependence of the inertia torque is taken into account by at least one additionally provided correction factor. It is thereby possible to raise the measuring accuracy further.

Moreover, there is a favorable refinement of the method in the case of which a speed regulator provided for the normal operation of the mill is switched off at least during one period of the drive test sequence. This prevents the speed regulator from intervening and correcting the change in speed brought about on purpose by the drive test sequence and for the purpose of evaluation. Even an only partial adjustment can lead to more inaccurate measurement results. However, when the speed regulator has a very long time constant which is, in particular, of the order of magnitude of the period of the drive test sequence or even greater, it is not mandatory for the speed regulator to be switched off.

It may be advantageous to provide that an inertia torque of the loaded and driven drum and a static friction factor of a speed-dependent friction torque are determined from the speed characteristic and the drive test sequence. Dependence of the friction torque on speed can be taken into account by such a method.

It may be also advantageous when the inertia torque and the static friction factor are determined on the basis of a linear model, the linear model describing the dependence of the speed on the drive torque. A linear model reproduces the dependence between the speed and the drive torque of the mill with sufficient accuracy, the parameters of the linear model being easy to determine.

It may be also advantageously provided that the linear model is a PT1 element and, in order to determine the inertia torque and the static friction factor, the PT1 element is tuned at two instants with measured values of the speed and of the drive torque. A PT1 element has only two unknown parameters, and these can easily be determined by evaluating the PT1 element at two different instants. The computational outlay thereby required is very low, and so it is possible to determine the parameters even in the event of limited storage capacity and computing power.

The object is likewise achieved by a control device with the aid of which the filling level of a loaded drum of a mill can be determined in accordance with a method as claimed in one of claims 1 to 15. To this end, the control device is provided with a program code that has control commands that prompt the control device to carry out the method as claimed in one of claims 1 to 15.

The various embodiments further extends to a machine-legible program code for a control device for a mill, which has control commands that prompt the control device to carry out the method described above. The machine-legible program code can also be stored on a control device that is already present for the mill and not provided with the program code, and can thus enable the method to be carried out in a mill previously operated conventionally according to various embodiments.

Furthermore, the various embodiments extends to a storage medium or computer program product comprising a machine-legible program code that is stored thereon, as has been described above.

FIG. 1 shows an exemplary embodiment of a mill 1 having a drum 2 and a control and regulation unit 3, in a schematic illustration. The mill 1 is an ore mill that is designed as a ball mill or as an SAG mill. The drum 2 is connected to a feed shaft 4, by means of which ore material 5 to be milled passes into the interior of the drum 2. The loaded drum 2 can be driven to rotate about a rotation axis 7 by means of a drive 6, designed as a gearless electric motor in the exemplary embodiment, in order to comminute the ore material 5.

A speed sensor 8 for acquiring a speed n of the drum 2 is provided at the drum 2. The speed sensor 8 is connected to the control and regulation unit 3. The latter comprises, in particular, at least a central arithmetic logic unit 9, for example in the form of a microcomputer, microprocessor or microcontroller module, a speed regulator 10 connected to the speed sensor 8, and a drive controller 11 connected to the drive 6. The speed regulator 10 and the drive controller 11 are connected to one another by means of a switch 12. The speed regulator 10, the drive controller 11 and the switch 12 are connected to the central arithmetic logic unit 9.

The speed regulator 10, the drive controller 11 and also the switch 12 can be physically existing, for example electronic modules, or else software modules that are stored in a memory (not shown in more detail) and run in the central arithmetic logic unit 9 after being called up. Said individual components 9 to 11 interact with further components and/or units that are not shown in FIG. 1 for reasons of clarity. Moreover, the control and regulation unit 3 can be designed as a single unit or as a combination of a number of separate subunits.

The mode of operation and particular method cycles and advantages of the mill 1 are described below, as well, with reference to FIGS. 2 to 7.

The introduced ore material 5 is milled on the basis of the rotational movement of the drum 2 effected by the drive 6. Additional steel balls can be introduced into the drum 2 in order to support the milling operation. Moreover, water is supplied in the case of the mill 1 designed as an ore mill in the exemplary embodiment, so that there is located in the interior of the drum 2 a filling stock 13 that is essentially a suspension with a proportion of solids that is formed by the more or less strongly comminuted ore material 5 and the steel balls.

Figure 2:
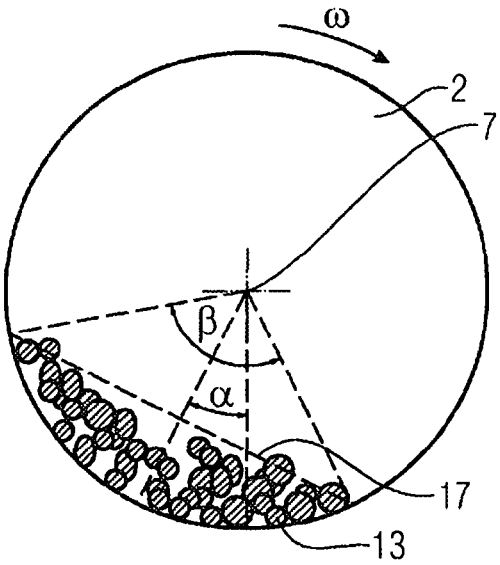
FIGS. 2 and 3 show a cross section II-II and III-III, respectively, perpendicular to the rotation axis through the drum of the mill in accordance with FIG. 1, in conjunction with a variable distribution of the drum contents.
Figure 3:
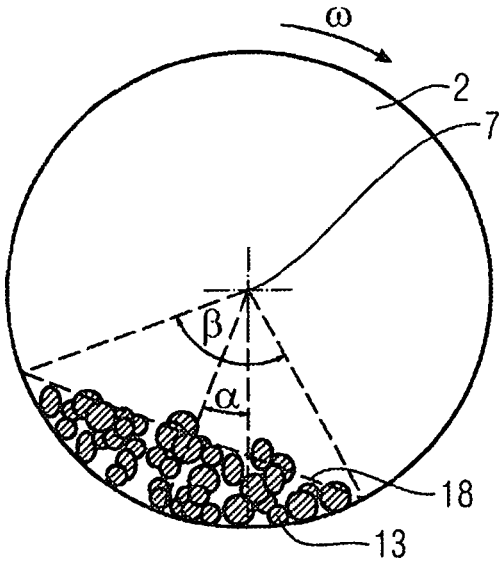

The filling stock 13 and two of its possible distributions within the rotating drum 2 are to be seen from the cross-sectional illustrations in accordance with FIGS. 2 and 3. Cross sections through the drum 2 perpendicular to the rotation axis 7 are shown. The illustrations are highly schematic. In particular, there are no details of the drum wall such as, for example, the driving webs or drivers (known technically as liners in English) arranged distributed in the circumferential direction on the inner side of the drum wall.

The distribution of the filling stock 13 in the drum 2 can vary during operation. It depends on various parameters such as the filling height and, to some extent, also the speed n. Typically, the drum 2 is filled to 45-50%, the result being an angle $\alpha$ of 45°-55° and an angle $\beta$ of approximately 140°. Moreover, it is subjected to stochastic fluctuations. Given the state of distribution in accordance with FIG. 2, a portion of the filling stock 13 is located relatively far above at the drum inner wall owing to the driving effect of the drum 2. After this portion has slipped down in the direction of the lowest position of the drum interior, the filling stock is in the state of distribution shown in FIG. 3. Such variations can be repeated cyclically and/or acyclically.

During operation, the filling degree of the mill 1 changes as a function of various influencing parameters. An accurate knowledge of the current state of filling is desirable in order to set the mill operation parameters as well as possible, and thus to operate the mill 1 as efficiently as possible.

On the basis of specially implemented methods, the mill 1 enables the determination of the filling level of the filling stock 13 in the drum 2, in particular even when operation is going on. This determination of filling level is based on the acquisition and evaluation of the speed n of the drum 2.

In a first refinement of this method, step responses of the speed n are analyzed as a reaction to a steplike variation in a drive torque M of the drive 6. A particular drive test sequence 14 is set as input variable for the drive torque M. This is performed by means of appropriate stipulations at the drive controller 11, which then activates the drive 6 such that it supplies a drive torque M in accordance with the desired drive test sequence 14.

Figure 4:
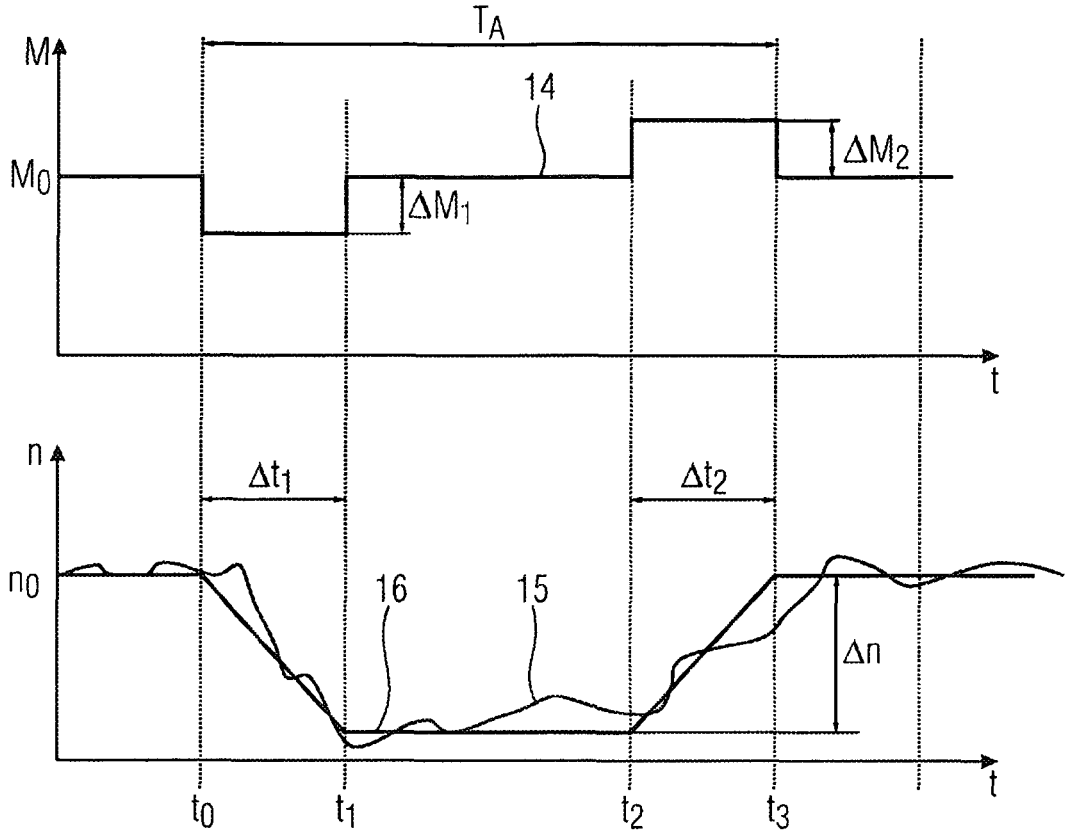
FIG. 4 shows timing diagrams of a drive test sequence, set by the control and regulation unit, for a drive torque acting on the drum and a detected, as well as an expected, characteristic of a speed caused by the drive test sequence.

An example of such a drive test sequence 14 is shown in the upper diagram of FIG. 4. The characteristic of the drive torque M, plotted against time t, exhibits short-term and slight deviations from a fundamental value $M_0$ that is assumed by the drive torque M at this instant on the basis of the stipulations of the drive controller 11 conditioned by the normal operational requirements. These deviations are steplike. In particular, the drive test sequence 14 comprises two square-wave pulses, superposed on the fundamental value $M_0$, with a pulse height $\Delta M_1$ or $\Delta M_2$ and a pulse duration $\Delta t_1$ or $\Delta t_2$.

The two square-wave pulses have opposite signs. The first square-wave pulse leads to a discontinuous drop in the drive torque M, while the second square-wave pulse leads to a discontinuous rise therein. This sequence is advantageous, since the mill 1 is usually operated at approximately 80% of its critical speed $n_{krit}$. In order reliably to prevent an overshooting of this critical speed $n_{krit}$ even during the phase of the drive test sequence 14, it is recommended firstly to provide the negative square-wave pulse with the drop in the drive torque M between the instants $t_0$ and $t_1$, and only thereafter to provide the positive square-wave pulse with the rise in the drive torque M between the instants $t_2$ and $t_3$.

The effect on the speed n is in accordance therewith. The first negative square-wave pulse of the drive test sequence 14 causes the speed n to drop, but the second positive square-wave pulse leads to a rise back to the initial speed value $n_0$. A time characteristic 15 of the speed n, as measured with the aid of the speed sensor 8, and a time characteristic 16 of the speed n, as expected given the constant inertia torque, are illustrated schematically in the lower diagram of FIG. 4. The change in speed $\Delta n$ can be determined by averaging the measured time characteristic 15, and with the aid of a root mean square fits to a curve with the known parameters $\Delta t_1$ and $\Delta t_2$ and with a change in speed $\Delta n$, effected by the drive test sequence 14, as an unknown parameter. In the simplest case, this can be done by subtracting the measured time characteristic 15, averaged in the region between the instants $t_1$ and $t_2$, from the initial speed value $n_0$. The averaging is performed in the control and regulation unit 3, low-pass filtering being used, for example. Overall, the change in speed $\Delta n$ effected by the drive test sequence 14 can be determined in this way.

In order to ensure that the change in speed $\Delta n$, which is to be acquired as the applicable measured variable, is not balanced out by the speed regulator 10 quickly intervening, the speed regulator 10 is switched off for a period $T_A$ of the drive sequence 14 by means of the switch 12. However, this measure is not mandatory. It can be omitted when the delay time of the speed regulator 10 is greater than the period $T_A$ of the drive sequence 14.

A very good estimated value for an inertia torque J—firstly assumed to be temporally constant, that is to say static—of the loaded drum 2 can be calculated from the acquired change in speed $\Delta n$ and from the prescribed parameters of the drive sequence 14.

This method of analysis starts from the following relationships. An acceleration of a rotating mass m with a constant inertia torque J requires an acceleration torque $M_a$ in accordance with $$M_a = J \cdot \frac{d\omega}{dt}, \tag{1}$$

$\omega$ denoting the angular velocity of the rotating mass m. The relationship:

$$\omega = \frac{d\alpha}{dt} \tag{2}$$

holds between an angle of rotation $\alpha$ and the angular velocity $\omega$.

The angle of rotation $\alpha$ by which the centroid of the filling stock 13 is respectively deflected from the rest position with a stationary drum 2 is also plotted in the cross-sectional illustrations in accordance with FIGS. 2 and 3.

In order to set the drum 2 into a rotational movement, the drive torque M applied by the drive 6 counteracts a friction moment $M_r$, caused for example by the friction losses in the bearing of the drum 2, as well as a restoring milling moment $M_m$, caused by the deflection of the filling stock 13, and at the same time supplies the acceleration torque $M_a$ required for the rotation. It therefore holds that:

$$M = M_r + M_m + M_a \tag{3}$$

Assuming a static inertia torque J, and given the stipulation of a drive test sequence 14 with two square-wave pulses of identical pulse height $\Delta M_1 = \Delta M_2 = \Delta M$ and identical pulse durations $\Delta t_1 = \Delta t_2 = \Delta t$, the first estimate sought for the inertia torque J results from equation (1) as:

$$J = \frac{60 \cdot \Delta M \cdot \Delta t}{2 \cdot \pi \cdot \Delta n} = C \cdot \frac{\Delta M \cdot \Delta t}{\Delta n}, \quad (4)$$

the change in speed Δn being taken from the measured or expected speed characteristic 15 or 16, and a conversion being undertaken between the angle of velocity ω, specified in radians per second, and the speed n specified in revolutions per minute. C stands for a proportionality constant.

The parameters ΔM and Δt of the drive test sequence 14 are dimensioned such that, firstly, a measuring effect that can be acquired results in the speed characteristic 15 or 16, but that, secondly, the change in speed Δn remains small enough that there is no appreciable impairment of the milling operation, in particular that proceeding during the measuring phase, and all of the throughput of the mill 1. A small resulting change in speed Δn ensures, moreover, that speed dependencies of, for example, the inertia torque J and the milling torque $M_m$ do not come to bear, and that the static relationships firstly assumed here also really do obtain to a good approximation. In the exemplary embodiment, the pulse heights $\Delta M_1=\Delta M_2=\Delta M$ are therefore approximately 5% of the fundamental value $M_0$. The pulse durations $\Delta t_1=\Delta t_2=\Delta t$ are respectively approximately 5 s.

The filling level that is actually of interest can be inferred with the aid of the estimate for the inertia torque J as determined in accordance with equation (4).

The following relationship holds in general for the inertia torque J:

$$J=\int r^2 \cdot dm \quad (5),$$

r denoting a distance of a differential mass dm from the rotation axis 7.

As may be seen from the illustrations in accordance with FIGS. 2 and 3, the filling stock 13 is located at least on average inside a circular arc segment. The respective chords 17 and 18 of the assumed circular arc segments are also plotted for the two distribution states shown in FIGS. 2 and 3. Their imaginary points of intersection with the drum wall form in FIGS. 2 and 3 filling angles β that are likewise also plotted and depend on the respective distribution state of the filling stock 13 inside the drum 2.

It has emerged that the assumption of a distribution of filling stock in the form of a circular arc segment is fulfilled very well in practice—at least as long as the speed n is in the original region below the critical speed $n_{krit}$.

Consequently information relating to the current filling is yielded from a comparison of the estimate, determined in accordance with equation (4), of the inertia torque J with the inertia torque, to be calculated analytically or numerically, of a mass in the shape of a circular arc segment rotating about a rotation axis.

Figure 5:
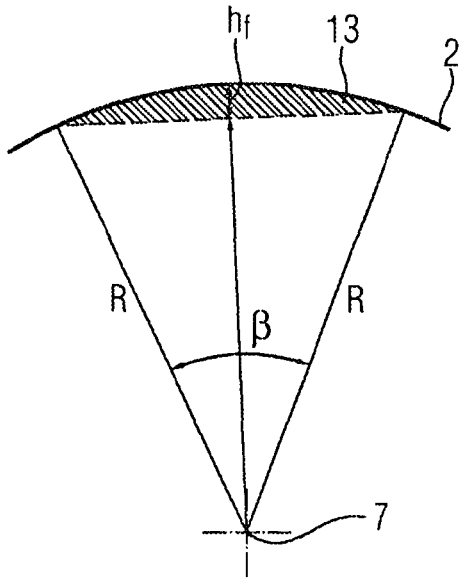
FIG. 5 shows a circular arc segment corresponding to an average distribution state of the drum contents.
Figure 6:
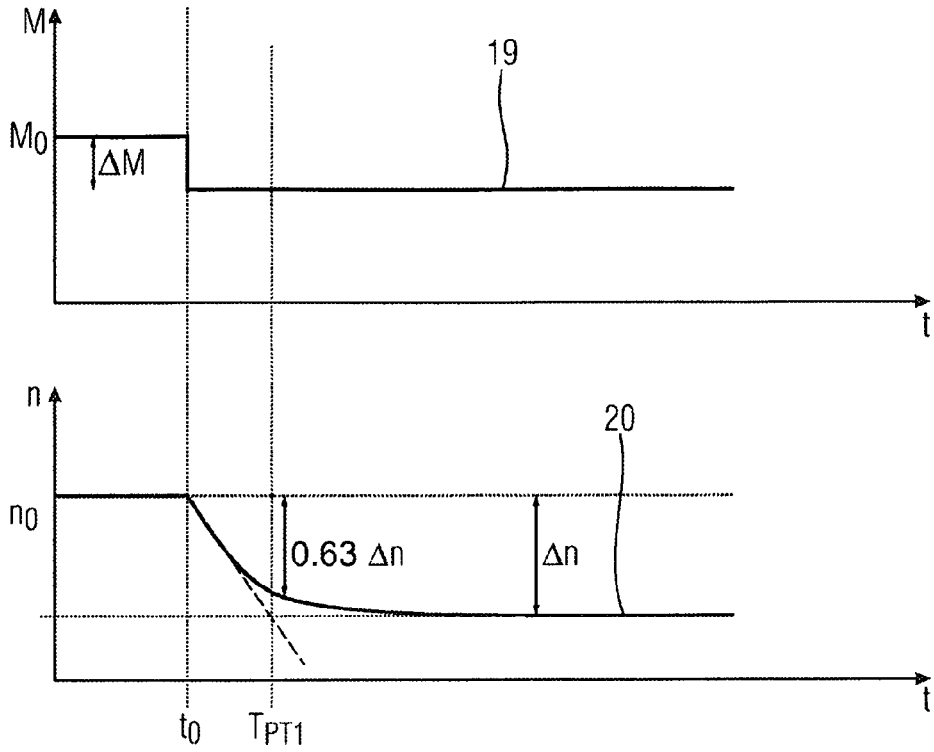
FIG. 6 shows timing diagrams of a negative step excitation of a drive torque acting on the drum, and of an approximately expected step response of the speed.
Figure 7:
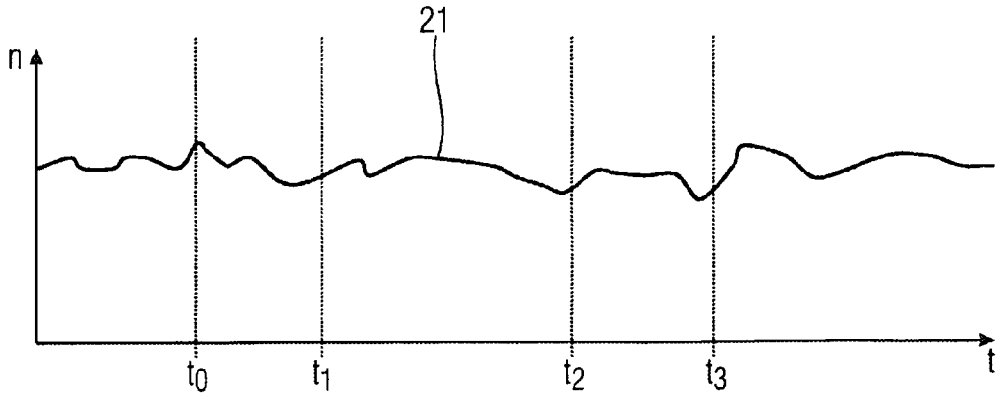
FIG. 7 shows a timing diagram of a difference between the acquired characteristic and the expected, unperturbed characteristic in accordance with FIG. 4.

With reference to the illustration in accordance with FIG. 5, the following calculation rule can be derived from equation (5) for the inertia torque of a mass in the shape of a circular arc segment rotating about a rotation axis:

$$J = \rho \cdot l \cdot R^4 \cdot \left[\frac{\beta}{4} - \frac{\cos(\beta/2)\cdot\sin^3(\beta/2)}{6} - \frac{\cos^3(\beta/2)\cdot\sin(\beta/2)}{2}\right], \quad (6)$$

ρ denoting a filling stock density that is assumed to be constant and approximately known, R denoting a drum radius, and l denoting an axial drum length in the direction of the rotation axis 7.

The estimate, determined in accordance with equation (4), for the inertia torque J is inserted into equation (6). The resulting relationship is solved either analytically or numerically for the filling angle β.

The filling angle β thus determined is already a measure of the filling of the drum 2. If necessary, it can be converted into a filling height $h_f$ in accordance with:

$$h_f=R\cdot[l-\cos(\beta/2)] \quad (7).$$

The measurement results can be further refined when the time dependencies of the various parameters, in particular that of the inertia torque J, are also taken into account. To this end, the torque equation (3) is wholly dynamicized, that is to say dependences of the individual torques on time t are introduced:

$$M=M_r(t)+M_m(t)+M_a(t) \quad (8).$$

It is assumed that $M_r(t)$ is dependent on speed in a fashion according to:

$$M_r(t)=M_r^*\cdot\omega=M_r^*\cdot\dot{\alpha} \quad (9),$$

$M_r^*$: denoting a temporally constant friction factor. The time dependence of the product expression in accordance with equation (9) is thus caused exclusively by the speed n or the angular velocity ω.

The milling characteristic, which is dependent on the angle of rotation and thus likewise on time, is further taken into account. It features in the restoring milling torque $M_m(t)$:

$$M_m(t)=M_m^*\cdot\sin(\alpha) \quad (10)$$

$M_m^*$ denoting a temporally constant restoring factor. The time dependence is therefore again determined only by the product factor sin(α), that is to say by the time-dependent angle of rotation α.

In addition to the time dependence of the angular velocity ω, in the acceleration torque $M_a(t)$ account is now also taken of that of the inertia torque J. It is therefore thus yielded as:

$$M_a(t) = \frac{d(J\cdot\omega)}{dt} = \frac{d(J\cdot\dot{\alpha})}{dt} = J\cdot\ddot{\alpha} + \dot{J}\cdot\dot{\alpha}. \quad (11)$$

By taking account of equations (9)-(11), it is possible to transform equation (8) into:

$$M=J\cdot\ddot{\alpha}+(\dot{J}+M_r^*)\cdot\dot{\alpha}+M_m^*\cdot\sin(\alpha) \quad (12)$$

Assuming a small angle of rotation α for which it holds that sin(α)≈α, equation (12) is the differential equation of a damped pendulum.

In order to represent the conditions in the interior of the drum 2 as realistically as possible, a secondary condition that describes the slip through condition is also introduced. As already explained with the aid of FIGS. 2 and 3, the filling stock 13 falls or slips downward again when it has reached a specific upper position at the drum inner wall. This upper position can be assigned a limiting angle of rotation $\alpha_0$. It likewise depends on the angular velocity ω. Consequently, a delimitation of the angle of rotation α that is determined by the speed-dependent limiting angle of rotation $\alpha_0$ can be supplemented in equation (12) as secondary condition:

$$M=J\cdot\ddot{\alpha}+(\dot{J}+M_r^*)\cdot\dot{\alpha}+M_m^*\cdot\sin(\min(\alpha,\alpha_0(\dot{\alpha}))) \quad (13).$$

Equation (13) can be solved numerically, for example by means of expansion about the operating point $\alpha_0$.

Any additional information relating to the behavior of the mill 1 that has been obtained, for example, during the commissioning phase or during a standstill can also be included.

In particular, the inertia torque J of the empty drum 2 can be determined without any problem during the commissioning. In addition, the inertia torque J of the drum 2 loaded with a test filling can also be determined by a discharge test undertaken during the commissioning phase and during which the drive 6 is switched off discontinuously. The period of the resulting oscillation is yielded by the known equations for the damped physical pendulum.

The additional information thus obtained can, in particular, be used to calibrate the method for acquiring the filling level.

In the case of one variant, in this way and taking account of the acquired and still unfiltered characteristic 15 of the speed n, time- or/and speed-dependent correction factors are determined that are taken into account in the evaluation of equations (4) and (6). These correction factors can, for example, describe a time-dependent deviation from the distribution of the filling stock 13 inside the drum 2 that is shaped exactly like a circular arc segment. In this case, the fluctuations included in the acquired characteristic 15 are thus also evaluated in order to arrive at a very exact and updated result for the filling level.

In the case of a further preferred variant, the fully dynamic simulation is used only offline, in order to be able to better analyze and quantify the influence of the friction described in equation (13) by $M_r^* \cdot \dot{\alpha}$, and of the restoring milling torque described in equation (13) by $M_m^* \cdot \sin(\min(\alpha, \alpha_0(\dot{\alpha})))$. It is possible in this way to estimate, for example, the form of step response from the structure of equation (13).

If the angle of rotation $\alpha$ has already reached the slipthrough condition $\alpha_0$ during operation, the speed dependency can be approximately linearized. It holds approximately that:

$$\sin(\min(\alpha, \alpha_0(\dot{\alpha}))) \approx \sin(\alpha_0 + \epsilon\dot{\alpha}) \approx \sin(\alpha_0) + \epsilon\dot{\alpha} \cdot \cos(\alpha_0) \quad (14),$$

$\epsilon$ denoting a small perturbation. This approximation simplifies equation (13) such that it has the known structure of a PT1 element.

The solution of the differential equation of a PT1 element for a step excitation is known. It has the general form of:

$$K\left(1 - \exp\left(-\frac{t}{T_{PT1}}\right)\right), \quad (15)$$

K denoting an amplitude constant, and $T_{PT1}$ denoting a time constant of the PT1 element. Upon transferal to a step excitation 19, shown in the upper diagram of FIG. 6, with a negative step change in the drive torque M at the instant $t_0$, the following fundamental structure of the step response 20, shown in the lower diagram of FIG. 6, results for the speed n(t) on the basis of the PT1 model:

$$n(t) = n_0 - \Delta n\left(1 - \exp\left(-\frac{(t - t_0)}{T_{PT1}}\right)\right) \quad \text{for } t \geq t_0 \quad (16a)$$

$$n(t) = n_o \quad \text{for } t < t_0. \quad (16b)$$

The approximately expected functions in accordance with equation (15) or (16) are fitted to the measured data. This fit supplies the parameters K or $\Delta n$ and $T_{PT1}$ that are initially still unknown in equation (15) or (16). Apart from the offset $n_0$, the response to the step change from $M_0$ to $M_0 - \Delta M$ is determined at least initially by the gradient $$\frac{K}{T_{PT1}} = \frac{\Delta M}{J} = \frac{\Delta\dot{\alpha}}{\Delta t}. \quad (17)$$

The static case thus results again (compare equation (4)). Overall, it is thus possible to determine the inertia torque J from the initial gradient K/T even in the dynamic case by fitting a PT1 element with the free parameters T and K or $\Delta n$ to the measured time characteristic 15.

During the approximation in accordance with equation (14), the nonlinear (sinusoidal) component was linearized and regarded as a small perturbation 8. The evaluation of the initial gradient of the PT1 element simplifies the analytical relationships, since a few complex, unknown terms can be shortened. However, if higher orders in $\epsilon$, for example, are also taken into account, this results in the square terms in $\dot{\alpha}$, and so the differential equation (13) can no longer be solved analytically.

However, it is then possible, for example, to develop a solution by applying perturbation theory with the aid of the perturbation formulation:

$$\alpha(t) = \alpha_0(t) + \lambda\alpha_1(t) + \lambda^2\alpha_2(t) + \ldots \quad (18),$$

$\alpha_0(t)$ being the solution of the unperturbed system. Thus, the first step is to use the measured data to determine the speed n or the inertia torque J approximately by the calculation from the unperturbed solution. The resulting unperturbed solution of the speed n, which substantially corresponds to the expected time characteristic 16 in accordance with FIG. 4, is subtracted from the measured time characteristic 15 in accordance with FIG. 4. It is only the resulting perturbation difference signal 21 shown in the diagram in accordance with FIG. 7 that is further tested for its frequency components. Such a procedure is numerically advantageous, because known absolute components (=expected time characteristic 16) have already been eliminated.

Furthermore, the current filling level can be inferred from the acquired speed characteristic 15, which represents a step response, by means of a model inversion by taking account of the authoritative equation (13). The following system of equations, which comprises two individual equations, can be set up for this purpose on the basis of equation (13):

$$\dot{J} = \frac{[M - M_m^* \cdot \sin(\min(\alpha, \alpha_0(\dot{\alpha}))) - J \cdot \ddot{\alpha}]}{\dot{\alpha}} - M_r^* \quad (19a)$$

$$J = \int \dot{J} dt. \quad (19b)$$

The inertia torque J and its first time derivative $\dot{J}$ are the unknown variables to be determined. By contrast, the prescribed and, if appropriate, even repeatedly measured drive torque M and the measured angular velocity $\dot{\alpha}$, which corresponds substantially to the speed n, are known. Furthermore, the temporally constant restoring factor $M_m^*$ and the temporally constant friction factor $M_r^*$ can be determined at least approximately with the aid of a static calculation.

The (numerical) solution of the differential equation (13) is the angle of rotation $\alpha(J(t), M(t), \alpha_0(t))$, which depends on various parameters, or the speed n(t) of the drum 2, which can easily be determined therefrom, for a given J(t) and M(t). However, interest centers initially on the inertia torque J(t), at least as state variable. Model inversion is understood as the analytical solution of equation (13) for J(t). This will not succeed for the general, dynamic differential equation. The following formulation functions in J, for example, can be used for the numerical solution:

$$J(t)=p_0J_0+p_1J_1(t)+p_2J_2(t)+\ldots \quad (20).$$

The differential equation is thereby forward-solved, and the result is compared with the measured values. In equation (20), $J_0$ denotes the solution of the static problem, and $J_1(t)$ denotes an exemplary sinusoidal perturbation function, that is to say, for example, $J_1(t)=\sin(t/T_{St})$. The perturbation periodicity $T_{St}$ can be calculated, in particular, from the speed n and from the circumferential distance of the drivers in the drum 2. The optimization problem in the parameters $p_n$ is solved, for example, by a least square fit with the measured data. This can, in particular, be performed in an automated fashion and also online, that is to say during the operation of the mill.

In a further preferred variant, the torque equation (3) is partially dynamicized. The inertia torque J and the milling torque $M_m$ are assumed to be static, whereas the friction torque $M_r$ in accordance with equation (9) is assumed to be dependent on speed. The torque equation therefore results as:

$$M = M_r(t) + M_m + M_a(t) = M_r^* \cdot \omega + M_m + J \cdot \frac{d\omega}{dt}. \quad (21)$$

If equation (21) is regarded for a step change in the drive torque ΔM, this is simplified to:

$$\frac{d\omega}{dt} = -\frac{M_r^*}{J} \cdot \omega + \frac{1}{J} \cdot \Delta M. \quad (22)$$

Equation (22) has the structure of a PTI element with the differential equation $$\frac{dy}{dt} = -\frac{y}{T_{PT1}} + \frac{K}{T_{PT1}} \cdot u. \quad (23)$$

Comparison of equations (22) and (23) yields the following relationships:

$$\Delta M = u \quad (24a)$$

$$n = y \quad (24b)$$

$$M_r^* = \frac{60}{2\pi} \cdot \frac{1}{K} \quad (24c)$$

$$J = \frac{60}{2\pi} \cdot \frac{T_{PT1}}{K}. \quad (24d)$$

Equations (24c) and (24d) set up a relationship between the friction factor $M_r^*$ and the inertia torque J, which are unknown in equation (21) and to be determined, and the gain factor K and the time constant $T_{PT1}$ of a PT1 element. The gain factor K and the time constant $T_{PT1}$ can be determined by means of a parameter identification from measured values of the drive torque M and the speed n. The present aim is to identify two parameters K and $T_{PT1}$, the model of the milling behavior, that is to say the PT1 element, being linear.

The parameter identification is performed by a minimization algorithm that minimizes the square error, for example. The parameter identification can be carried out continuously in time or discretely in time. Since modern arithmetic logic units operate discretely in time, the time-discrete parameter identification is explained below.

If equation (23) is discretized, the result is:

$$y_{i+1} = \frac{K \cdot \Delta t}{T_{PT1}} \cdot u_i + \left(1 - \frac{\Delta t}{T_{PT1}}\right) \cdot y_i = p_i \cdot u_i + p_2 \cdot y_1, \quad (25)$$

Δt being the scanning time, and $$p_1 = \frac{K \cdot \Delta t}{T_{PT1}} \quad (26a)$$

and $$p_2 = 1 - \frac{\Delta t}{T_{PT1}}. \quad (26b)$$

The calculation of the unknown parameters is performed by minimizing the sum of the square errors between the model output $y_i$ and the corresponding measured values $y_i^{Mess}$ over N time steps. The aim is therefore to minimize the quality functional $$\sum_{i=1}^{N} (y_i - y_i^{Mess})^2. \quad (27)$$

In matrix terms, the solution for the overdetermined system of equations is yielded as:

$$p=(M^T \cdot M)^{-1} \cdot M^T \cdot y^{Mess} \quad (28),$$

p being a vector composed of $p_1$ and $p_2$, and $y^{Mess}$ being a vector composed of $y_2^{Mess}$ to $y_{N+1}^{Mess}$. M is a matrix composed of a vector u and y, u containing the measured input values $u_1$ to $u_N$ and the vector y containing the measured values $y_1^{Mess}$ to $y_N^{Mess}$.

Equation (28) becomes particularly simple when only N=2 time steps are considered. Since only two parameters are to be determined, it suffices to consider two time steps. Equation (28) yields:

$$M^T \cdot M \cdot p = M^T \cdot y^{Mess} \quad (29).$$

The introduction of abbreviations yields the following from equation (29):

$$A \cdot p = b \quad (30).$$

Equation (30) can be solved for p, thus producing the following equation:

$$p = A^{-1} \cdot b \quad (31).$$

The following result is thus obtained for the unknown parameters $p_1$ and $p_2$:

$$p_1 = \frac{b_1 \cdot a_{22} - b_2 \cdot a_{12}}{a_{11} \cdot a_{22} - a_{12} \cdot a_{21}} \quad (32)$$

$$p_2 = \frac{b_2 \cdot a_{11} - b_1 \cdot a_{21}}{a_{11} \cdot a_{22} - a_{12} \cdot a_{21}}. \quad (33)$$

$b_1$ and $b_2$ are the elements of the vector b, and $a_{ij}$ are the elements of the matrix A in the ith row and jth column.

Since $a_{12}$ is always equal to $a_{21}$, the unknown parameters $p_1$ and $p_2$ can be determined by evaluating two consecutive time steps, only five values, specifically $a_{11}$, $a_{12}$, $a_{22}$, $b_1$ and $b_2$ needing to be evaluated. It is thereby possible to determine the unknown parameters $p_1$ and $p_2$, even in arithmetic logic units, with limited computing power and storage capacity. It is possible to calculate back to the gain factor K and the time constant $T_{PT1}$ of the PT1 element with the aid of the parameters $p_1$ and $p_2$ and the known scanning time $\Delta t$. Furthermore, it possible to calculate back to the unknown friction factor $M_r$* and the unknown inertia torque J from the gain factor K and the time constant $T_{PT1}$. The filling level of the drum 2 can be inferred in a known way with the aid of these calculated variables.

Should the system of equations be badly conditioned, a remedy is provided by a singularity value breakdown. Alternatively, it is also possible to carry out a Householder transformation or a Gram-Schmidt QR breakdown.

Even more complex linear models having three or more free parameters can also be determined using the method presented.

All the above-described method steps are carried out in the control and regulation unit 3, in particular in the central arithmetic logic unit 9. It is preferably performed in an automated and cyclical fashion as the mill is operating, and so very accurately determined information relating to the respectively current filling of the drum 2 is present in the control and regulation unit 3. Said information can be used for an improved control and/or regulation of the mill operation.

In the case of another refinement of the method for acquiring the filling level, it is possible, even without a specially prescribed drive test sequence 14 and instead thereof, to work with the drive torque M that results at the drive 6 by virtue of the stipulations made by the drive controller 11 for normal mill operation. The characteristic 15 of the speed n, which is acquired even in this case, is then firstly subjected to a Fourier transformation in the regulation and control unit 3.

The frequency signal of the speed characteristic n, which is subsequently in the form of a Fourier transform, is tested, in particular, for the present frequency components and their amplitude and phase angles. It is possible therefrom to derive information relating to the current filling level of the drum 2 and, if appropriate, relating to further operating parameters, such as the mass distribution in the drum 2, the grain size distribution in the ore material 5, and the proportion of steel balls.

What is claimed is:

1. A method for determining a filling level of a loaded drum of a mill, comprising the steps of:

a) applying a drive torque to the leaded drum, the drive torque setting the loaded drum into a rotational movement, b) wherein a magnitude of the drive torque is set in accordance with a predetermined drive test sequence, c) recording a time/rotation speed profile resulting from the application of the drive torque, d) analyzing the time/rotation speed profile to determine an inertia torque of the loaded drum, and e) determining the filling level of the loaded drum based at least on results of the analysis.

2. The method as claimed in claim 1, further comprising generating a speed frequency signal by applying a Fourier transformation to the time/rotation speed profile during the analysis of the time rotation speed profile.

3. The method as claimed in claim 2, wherein the filling level is determined based at least on the presence, the amplitude, or the phase of specific frequency components.

4. The method as claimed in claim 2, wherein the predetermined drive test sequence includes a constant drive torque.

5. The method as claimed in claim 4, wherein the constant drive torque is prescribed by a drive controller.

6. The method as claimed in claim 2, wherein the predetermined drive test sequence includes a drive torque that is used for the normal operation of the mill.

7. The method as claimed in claim 1, wherein analyzing the time/rotation speed profile includes filtering or averaging the time/rotation speed profile.

8. The method as claimed in claim 1, wherein the predetermined drive test sequence includes at least one step change in the drive torque.

9. The method as claimed in claim 8, wherein the at least ones change in the drive torque adjusts the drive torque in a range of up to 30%.

10. The method as claimed in claim 8, wherein the at least one step change includes a pulse duration and a pulse height determining a change in the drive torque, and determining the inertia torque includes determining a first measured value of the inertia torque based at least on the pulse duration, the pulse height, and a speed change caused by the drive test sequence.

11. The method as claimed in claim 10, wherein determining the filing level includes:

comparing the first measured value based on the inertia torque of the loaded and driven drum to a second measured value based on the inertia torque of a circular arc segment; and calculating a filling angle or a filling height based at least on the result of the comparison.

12. The method as claimed in claim 8, wherein the change in the drive torque referred to an initial value of the drive torque moves in a range of up to 10% or up to 2%.

13. The method as claimed in claim 1, wherein determining the inertia torque includes at least one additional correction factor applied to the time or the rotational speed of the time/rotational speed profile.

14. The method as claimed in claim 1, further comprising switching off a speed regulator provided for the normal operation of the mill during at least one period of the drive test sequence.

15. The method as claimed in claim 1, further comprising determining a static friction factor of a speed dependent friction torque based at least on the time/rotational speed profile and the predetermined drive test sequence.

16. The method as claimed in claim 15, wherein the inertia torque and the static friction factor are determined based at least on a linear mode, the linear model describing the dependence of the speed on the drive torque.

17. The method as claimed in claim 16, wherein the linear model includes a PT1 element and, in order to determine the inertia torque and the static friction factor, the PT1 element is tuned at two instants with measured values of the speed and of the drive torque.

18. The method as claimed in claim 1, wherein a drive torque having at least one step change in the form of a square-wave pulse, is prescribed as drive test sequence.

19. The method as claimed in claim 1, wherein a speed frequency signal that is tested with regard to the frequency components involved is generated from the acquired temporal speed characteristic by means of a Fourier transformation during the analysis of the speed characteristic.

* * * * *